US007275879B2

(12) United States Patent
Kunihiro et al.

(10) Patent No.: US 7,275,879 B2
(45) Date of Patent: Oct. 2, 2007

(54) PROCESSING DEVICE OF PHOTO-SENSITIVE MATERIAL

(75) Inventors: Akira Kunihiro, Tokyo (JP); Sadao Kuriu, Tokyo (JP); Takanori Takei, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 138 days.

(21) Appl. No.: 11/062,450

(22) Filed: Feb. 22, 2005

(65) Prior Publication Data

US 2005/0185953 A1 Aug. 25, 2005

(30) Foreign Application Priority Data

Feb. 23, 2004 (JP) ..... 2004-046110

(51) Int. Cl.
*G03D 3/02* (2006.01)
*G03D 3/08* (2006.01)
*G03D 5/00* (2006.01)

(52) U.S. Cl. ..... 396/604; 396/612; 396/627; 355/27

(58) Field of Classification Search ..... 396/604, 396/609, 612, 627; 355/27
See application file for complete search history.

(56) References Cited

U.S. PATENT DOCUMENTS 6,478,483 B2 * 11/2002 Maruyama et al. ..... 396/604

FOREIGN PATENT DOCUMENTS

| | | | |
|---|---|---|---|
| JP | 6-8956 | U | 2/1994 |
| JP | 6-27677 | A | 2/1994 |
| JP | 62-237455 | A | 8/1994 |
| JP | 2001-174970 | A | 6/2001 |
| JP | 2001-312036 | A | 11/2001 |

* cited by examiner

*Primary Examiner*—D. Rutledge
(74) *Attorney, Agent, or Firm*—Birch, Stewart, Kolasch & Birch, LLP

(57) ABSTRACT

Disclosed is a processing device of a photo-sensitive material which comprises a conveying device for conveying a photo-sensitive material, a slot die for applying a processing liquid to the photo-sensitive material conveyed by the conveying device, a reservoir tank of the processing liquid, a supply device of the processing liquid for supplying a processing liquid in the reservoir tank of the processing liquid to the slot die, a support roll of the photo-sensitive material arranged at a position opposite to and spaced from a tip of the slot die, a device for detecting a photo-sensitive material, and a driving device for rotating the support roll of the photo-sensitive material which can rotate the support roll at least in the direction reverse to a conveying direction of the photo-sensitive material.

8 Claims, 8 Drawing Sheets

PROCESSING DEVICE OF PHOTO-SENSITIVE MATERIAL

BACKGROUND OF THE INVENTION

1. Field of the Invention

The present invention relates to a processing device of a photo-sensitive material, more specifically to a processing device for applying a processing liquid using a slot die.

2. Description of the Related Art

A photo-sensitive material such as a film, a photographic paper, or a printing plate is processed with a processing liquid such as a developer, a fixer, a stabilizing liquid, or a washing water after an image is recorded. As a processing device of a photo-sensitive material for conducting such processing, there is known an immersion processing device which conducts the processing by conveying a photo-sensitive material into a processing vessel in which a processing liquid is pooled, using conveying means constituted from a plurality of conveying roller pairs or the like, and immersing the photo-sensitive material in the processing liquid.

In such immersion processing device, a processing liquid is deteriorated due to processing fatigue accompanying the processing of photo-sensitive materials, fatigue with age caused by carbon dioxide or oxygen in the air, or the like, and therefore the deterioration of the processing liquid is recuperated by replenishing a replenisher into the processing liquid. Accordingly, it means that the constituent of a processing liquid at the time of starting the processing differs from the constituent of a processing liquid in a case where the processing is continued afterwards, and therefore it is impossible to conduct a strictly uniform processing. Further, such immersion processing devices have such problems as high running cost due to large amount of the processing liquid consumed and wasted, and as bad maintenanceability of the device.

As a processing device of a photo-sensitive material for overcoming these problems, there is known an application processing device for applying to a sensitized surface of a photo-sensitive material a processing liquid in an amount necessary for the processing of the photo-sensitive material, instead of immersing a photo-sensitive material in a processing liquid, as set forth, for example, in Japanese Unexamined Patent Publication No. Sho 62-237455, Japanese Unexamined Utility Model Publication No. Hei 6-8956, Japanese Unexamined Patent Publication No. Hei 6-27677, Japanese Unexamined Patent Publication No. 2001-174970, and Japanese Unexamined Patent Publication No. 2001-312036.

In particular, a processing device using a slot die disclosed in the above Japanese Unexamined Patent Publication No. 2001-174970 has an advantage of applying stably and uniformly even in a less amount of the processing liquid, and of not substantially generating a waste liquid. However, some photo-sensitive materials require a uniform processing even at the end section, and unevenness in the processing, in particular, at the very tip (e.g. within 1 cm of the tip) sometimes became a problem. This phenomenon was prone to occur especially when the amount of application was set to less.

In order to improve this problem, Japanese Unexamined Patent Publication No. 2001-312036 discloses, in pages 1-3 and FIG. 1, a processing device for, using a slot die comprising at least a slit and a manifold, forming a film of a processing liquid between the tip of the slit and the member, before a photo-sensitive material reaches the slit, by providing a plane member (hereinafter, refelTed to as the photo-sensitive material support plane member) having a width more than application width in a position facing to and spaced from the tip of the slit. This processing device overcame nonuniformity of the application and unevenness in the processing at the application starting section of the tip of a photo-sensitive material.

However, some processing liquid which conducts a processing had a problem that the constituent of a processing liquid fixes and crystallizes between the tip of the slit and the photo-sensitive material support member facing thereto during a period of time when no processing is conducted. In particular, in a processing device using, for a section facing to the tip of the slit, the photo-sensitive material support plane member which has a flat surface, a processing liquid after the processing of a photo-sensitive material is prone to remain in a relatively large amount due to its flatness. The remaining processing liquid converts into a fixed crystalline material through drying. When the photo-sensitive material is processed under such state, the fixed crystalline material adheres to the surface of the photo-sensitive material between the tip of the slit and the photo-sensitive material support plane member, causing processing defect and flaws, which sometimes had a bad influence on 2nd version or 3rd version depending on a state of fixation. Accordingly, it was required to wipe the photo-sensitive material support plane member periodically or to pour into a large amount of rinsing liquid, resulting in occurring decreasing maintenanceability and increasing amount of waste liquid.

In this case, a great rinsing effect can be obtained by modifying the photo-sensitive material support plane member into a support roll, and, for example, by rinsing while rotating. However, in a case where a processing is conducted, there is a problem that only by modifying the photo-sensitive material support member into a support roll, a processing liquid is resistant to remaining between the tip of the slit and the support roll due to the unflatness of the surface facing to the tip of the slit, so that the application starting section of the very tip and both ends in the application width direction of the photo-sensitive material are applied nonuniformly, causing the occurrence of unevenness in the processing, as mentioned above.

Yet another problem is that when a metal such as aluminum is used for the support member of a photo-sensitive material, the photo-sensitive material may be damaged due to the friction of the photo-sensitive material by the support roll of the photo-sensitive material opposed to the tip of the slit. Thus, a resin is preferably used for the support roll of the photo-sensitive material, but in order to process a large-sized photo-sensitive material, it was required to lengthen the length of the photo-sensitive material support member in the application width direction, causing problems of maintaining straightness and costs. It is required to keep the gap constant in the width direction between the tip of the slit and the photo-sensitive material support member opposed to the tip of the slit, and this is the most important factor in applying a processing liquid to a photo-sensitive material uniformly in the width direction.

SUMMARY OF THE INVENTION

The present invention further improves a processing device using a slot die, i.e., to completely prevent the fixation and crystallization of a processing liquid on a processing liquid applied section with less amount of rinsing liquid, and provides a processing device of a photo-sensitive material which conducts stable application of a processing liquid even at the tip section of the processing of the photo-sensitive material. Further, the present invention keeps the gap constant in the width direction between the tip of the slit and the support roll of the photo-sensitive material opposed to the tip of the slit, and provides a processing device of a photo-sensitive material which uses a low-cost support roll of the photo-sensitive material.

The advantages of the present invention have been achieved by the following inventions:

(1) A processing device of a photo-sensitive material which comprises a conveying means for conveying a photo-sensitive material, a slot die for applying a processing liquid to the photo-sensitive material conveyed by the conveying means, a reservoir tank of the processing liquid, a supply means of the processing liquid for supplying a processing liquid in the reservoir tank of the processing liquid to the slot die, a support roll of the photo-sensitive material arranged at a position opposite to and spaced from a tip of the slot die, a detection means for detecting a position of the photo-sensitive material, and a driving means for rotating the support roll of the photo-sensitive material which can rotate the support roll at least in the direction reverse to a conveying direction of the photo-sensitive material.

(2) The processing device of a photo-sensitive material according to the above item (1), wherein the device further comprises a rotation control means for controlling the rotation of the support roll of the photo-sensitive material, the support roll of the photo-sensitive material is controlled so as to be rotated in the direction reverse to the conveying direction of the photo-sensitive material before the photo-sensitive material is conveyed to the position of the slot die by receiving signals from the detection means of the photo-sensitive material, and at the point in time when the photo-sensitive material reaches the position of the slot die, the support roll of the photo-sensitive material is controlled so as to be stopped rotating or rotated in the same direction as the conveying direction of the photo-sensitive material.

(3) The processing device of a photo-sensitive material according to the above item (1) or (2), wherein the device further comprises a supply control means of the processing liquid for controlling the supply and stop of the processing liquid from the supply means of the processing liquid and wherein the supply control means of the processing liquid is controlled so as to start supplying the processing liquid to the slot die before the photo-sensitive material is conveyed to the position of the slot die by receiving signals from the detection means of the photo-sensitive material.

(4) The processing device of a photo-sensitive material according to the above item (1), wherein a peripheral speed of the support roll of the photo-sensitive material is made slower than a conveying speed of the photo-sensitive material.

(5) The processing device of a photo-sensitive material according to the above item (1), wherein the device further comprises a supply means of a rinsing liquid for supplying the rinsing liquid to the support roll of the photo-sensitive material.

(6) The processing device of a photo-sensitive material according to the above item (5), wherein the device further comprises a diffusion means of a rinsing liquid for diffusing the rinsing liquid supplied to the support roll of the photo-sensitive material arranged in such a manner as to in contact with the support roll of the photo-sensitive material.

(7) The processing device of a photo-sensitive material according to the above item (1), wherein the slot die has at least a manifold and a slit, and wherein the relationship between the lengths in the conveying direction of the photo-sensitive material of the flat surface of the tip at both ends across the slit at the tip of the slot die satisfies the following condition:

(condition)

Length of the flat surface of the tip at the upstream side (L1)>Length of the flat surface of the tip at the downstream side (L2).

(8) The processing device of a photo-sensitive material according to the above item (1), wherein a support roll of the photo-sensitive material is used which comprises a metal roll and a tubular fluorine resin wound around it surface.

The processing device of a photo-sensitive material according to the present invention allows to completely prevent the fixation and crystallization of a processing liquid on a processing liquid applied section with less amount of rinsing liquid, and to conduct stable application of a processing liquid even at the tip section of the processing of the photo-sensitive material.

DETAILED DESCRIPTION OF THE INVENTION

Figure 1:
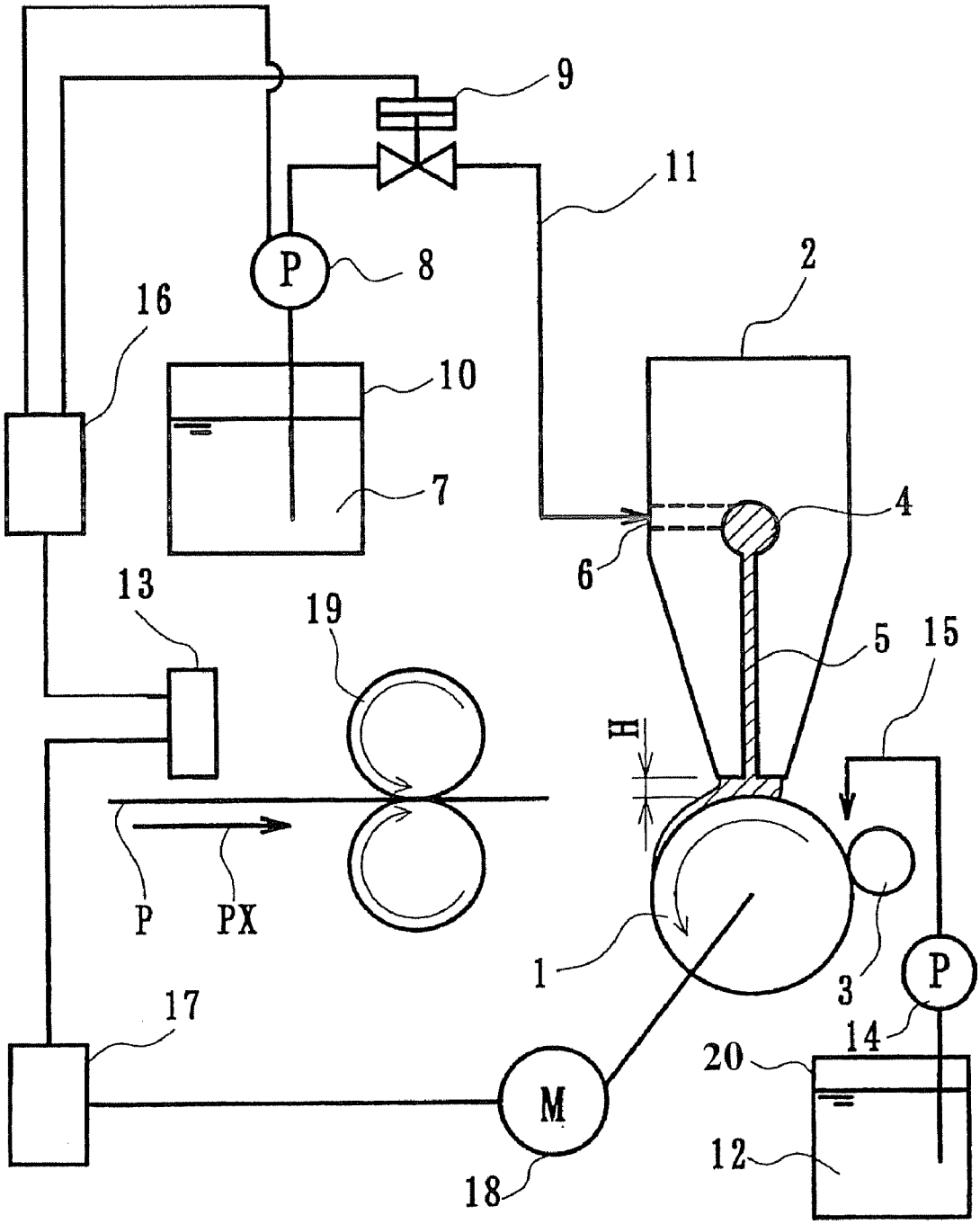
FIG. 1 is a cross section view of the processing device showing one embodiment of the present invention.

Hereinafter, the processing device of a photo-sensitive material according to the present invention is described in detail using drawings. FIG. 1 is a schematic cross section of the processing device of a photo-sensitive material which is one embodiment of the present invention. First, the structure of a slot die 2 is described. Indicated by reference numeral 6 is a processing liquid supply port, and is coupled to a nianifold 4. The manifold 4 serves to spread the influx of the processing liquid in a width direction, and is provided throughout the width direction of the slot die 2. After filling the processing liquid once in the manifold 4 in the width direction, supplying action to a slit section 5 is conducted, resulting in allowing the amount of the outflux to be uniformed in the width direction. The processing liquid supply port 6 is usually sufficient to be provided at a single location in the width direction 2 in the center of the slot die, but may be provided at a plurality of locations in the width direction of the slot die 2. The cross section of the manifold 4 has a circular shape in the present embodiment, but is not limited thereto and may have an arbitrary shape. In addition, the sectional area of the manifold 4 is not necessarily constant throughout the width direction of the slot die 2, and for example may be gradually decreased as reaching the end in order to further improve the uniformity in an amount of the outflux of the processing liquid in the width direction.

While not shown in FIG. 1 for convenience sake, both ends in the application width direction of the manifold 4 and both ends at the slit section 5 in the same direction of the slot die 2 should be plugged so that the processing liquid may not outpour. In this case, the above plugging should be conducted so that the length of the slit section 5 in the width direction is the same or slightly larger than the application width of the photo-sensitive material to be processed.

The material of the slot die 2 is not particularly limited, but would be sufficient if corrosion resistance against the processing liquid and mechanical precision is satisfied, and for example stainless steel is preferable. Other than that, general structure steel with chrome plating, plastics, or the like can be used. Further, when producing it with a metal, annealing treatment may be conducted in advance, in order to exclude the distortion of the stress during machining.

Indicated by reference numeral 10 in the figure is a reservoir tank of the processing liquid for pooling a processing liquid 7. Processing liquid supply means for supplying the processing liquid 7 in the reservoir tank of the processing liquid 10 is constituted from a pump 8, a valve 9 and piping 11. The piping 11 couples the reservoir tank to the processing liquid supply port 6 of the slot die 2, and there are provided therebetween respectively the pump 8 for sending the processing liquid and the valve 9 for stopping sending the processing liquid 7.

Indicated by reference character P is a photo-sensitive material, and is conveyed in a direction (arrow PX) from left to right in the figure by photo-sensitive material conveying roll pairs 19, one of photo-sensitive material conveying means. Indicated by reference numeral 13 is detection means for detecting a position of a photo-sensitive material P being conveyed, i.e., for detecting a top and an end portions of the photo-sensitive material to be processed, and a contact or non-contact detector should be used.

Indicated by reference numeral 16 is a supply control means of the processing liquid for controlling the supply and stop of the processing liquid from the processing liquid supply means. The supply control means of the processing liquid 16 drives the pump 8 and opens the valve 9 by detecting a leading end of the photo-sensitive material P being conveyed with the detection means 13, so as to supply the processing liquid 7 to the slot die 2. Further, by detecting a terminating end of the photo-sensitive material P with the detection means 13 in the same maimer, the pump 8 is stopped and the valve 9 is closed after a preset time is elapsed. Controlling in such a maimer allows uniform application of a certain constant amount of processing liquid to the photo-sensitive material P being conveyed.

When the amount of application to the photo-sensitive material P is intended to be controlled with high precision, a flow meter (not shown) should be placed in the midstream of the piping for the processing liquid, so as to configure to control the pump 8 and the valve 9 by feedback with signals from the flow meter as reference.

The amount of the flux of the processing liquid supplied to the slot die 2 can be determined by multiplying a desired amount of wet application of the processing liquid, the application width of the photo-sensitive material and the conveying speed of the photo-sensitive material together.

A support roll 1 of the photo-sensitive material which is one of the characteristic features of the present invention is arranged at a position facing and spaced from the tip of the slot die 2. Further, the support roll 1 of the photo-sensitive material is provided at least with driving means 18 such as a motor for rotating the support roll 1 in the direction opposite to the conveying direction of the photo-sensitive material P, and rotation control means 17 for controlling the rotation of the support roll 1 of the photo-sensitive material. Here, the terms "at least" in "the support roll 1 is provided at least with driving means 18" mean that the driving means may rotate the support roll 1 in the same direction as the conveying direction of the photo-sensitive material P and in the reverse direction to the same, but it is essential that the driving means has a means to rotate the support roll 1 in the direction opposite to the conveying direction, or in the reverse direction.

The support roll 1 of the photo-sensitive material is set to have a width more than the application width of the slot die 2 in the application width direction, and is arranged in such a manner that the central axis of the circle of the support roll 1 of the photo-sensitive material should be a downward vertical extension of the slit section 5. The diameter of the support roll 1 of the photo-sensitive material is preferably 20 mm or more, and more preferably 30 mm or more, with about 50 mm as the upper limit. The material of the surface of is not particularly limited if it has corrosion resistance against the processing liquid and high straightness, and for example stainless steel, plastics, fluorine resin or the like can be used.

However, as mentioned above, the processing liquid is resistant to pooling between the tip of the slot die 2 and the support roll 1 facing thereto since the support roll 1 of the photo-sensitive material is not flat at the surface opposed to the tip of the slot die 2. Yet another problem is that when a metal plate such as aluminum is used, in particular, for a support medium of a photo-sensitive material, the photo-sensitive material is damaged. In this case, a resin having the characteristic of high surface tension is preferably used for the surface material of the support roll 1 of the photo-sensitive material, and more preferably fluorine resin in particular is used. Thereby, the pooling of the liquid formed between the tip of the slot die 2 and the support roll 1 of the photo-sensitive material can be increased, a developer is prevented to run off immediately, and further a photo-sensitive material is prevented from being damaged.

Distance H between the support roll 1 of the photo-sensitive material and the tip (the tip of the slot die 2) of the slit section 5 is preferably within 3 mm, more preferably within 2 mm, further more preferably within 1.5 mm, and particularly preferably within 1.0 mm. The lower limit of the distance H is a distance by which a sensitized surface of the photo-sensitive material P is not brought into contact with the tip (the tip of the slot die 2) of the slit section 5.

Figure 8:
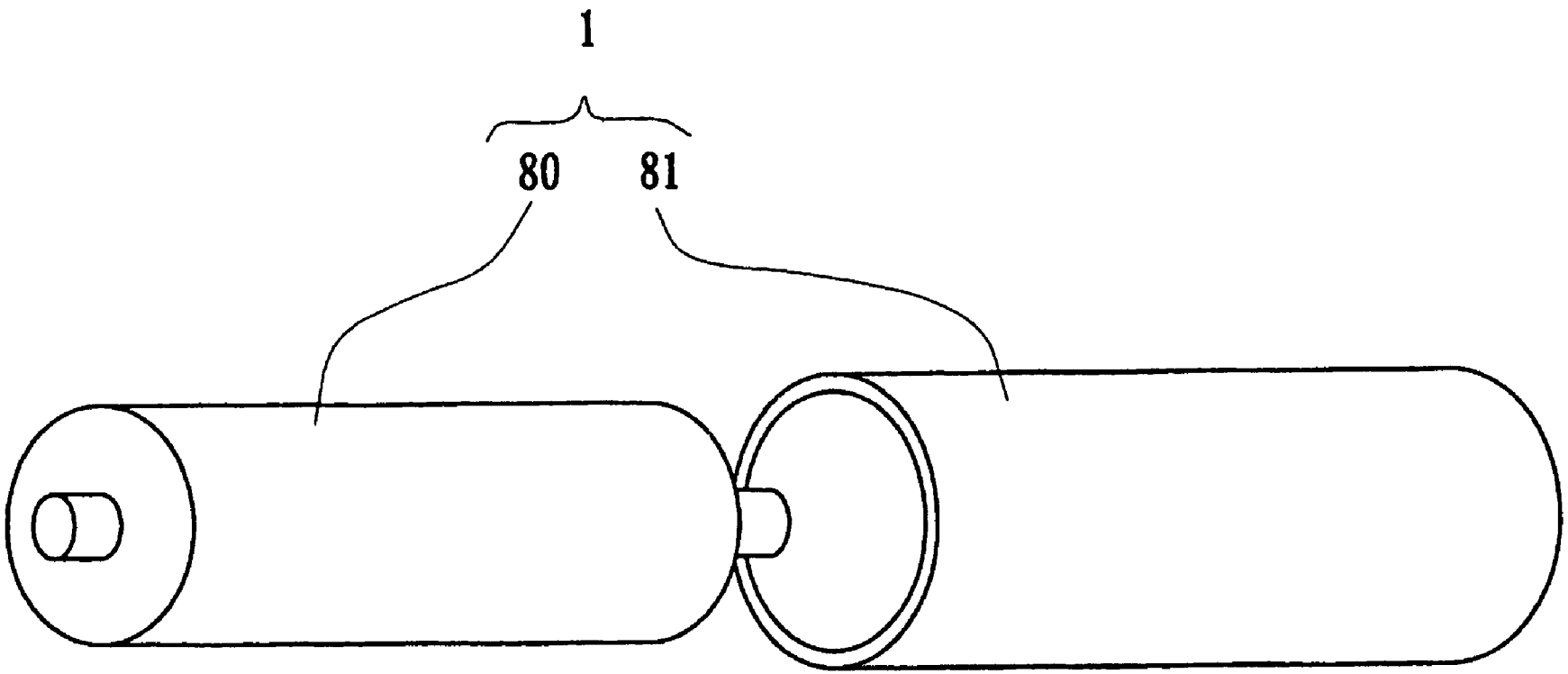
FIG. 8 is a perspective view showing an arrangement of the support roll of the photo-sensitive material.

In the processing device of the present invention, a support roll of the photo-sensitive material comprising a metal roll and a tubular fluorine resin wound around its surface is preferably used for the support roll 1 of the photo-sensitive material, since the distance H between the support roll 1 of the photo-sensitive material and the tip of the slit section 5 can be constantly stabilized and low-cost production can be achieved. FIG. 8 is a diagram showing component members of the support roll 1 of the photo-sensitive material. The support roll 1 of the photo-sensitive material comprises a metal roll 80 which constitutes a core and a tubular fluorine resin 81 which covers the surface of the metal roll 80. For a material of the metal roll 80, stainless steel is preferable, for the purpose of corrosion resistance against the processing liquid and of maintaining straightness of high precision. In addition, for the tubular fluorine resin 81, those of the type which can cover the overall surface of the metal roll and can shrink by heat is preferable since simplified and precise production can be achieved. For the fluorine resin 81, for example PTFE (polytetrafluoroethylene), FEP (tetrafluoroethylene-hexafluoropropylene copolymer), PFA (tetrafluoroethylene-perfluoroalkyl viny ether copolymer) or ETFE (tetrafluoroethylene-ethylene copolymer) can be used. The thickness of the fluorine resin 81 is preferably about 0.1 to 1.0 mm. Thus, by combining the metal roll 80 and the tubular fluorine resin 81, the production can be easily achieved while maintaining the precision of straightness of the support roll 1 of the photo-sensitive material.

In the present invention, the amount of application of the processing liquid is preferably 100 ml or less per 1 square meter. If the amount of application is set to less in this maimer, uniform processing for the tip of the photo-sensitive material becomes difficult. In particular, by employing a roll member for the photo-sensitive material support member, a processing liquid becomes resistant to remaining between the tip of the slit and the support roll 1 of the photo-sensitive material facing thereto. In order to solve this problem, the present invention is controlled such that the support roll 1 of the photo-sensitive material should be rotated in the direction opposite to the conveying direction (arrow PX) of the photo-sensitive material P by the driving means 18 while outpouring the processing liquid 7 from the tip of the slot die 2 using the supply means of the processing liquid in advance, by transmitting the signals detected by the detection means 13 to the supply control means of the processing liquid 16 and the rotation control means 17, before the photo-sensitive material P reaches the tip of the slot die 2.

By controlling in the above manner, the processing liquid 7 outpouring uniformly in the application width direction from the tip of the slot die 2 forms a slight liquid film between the tip of the slot die 2 and the support roll 1 of the photo-sensitive material. Then, by rotating the support roll 1 of the photo-sensitive material in the direction opposite to the conveying direction of the photo-sensitive material, the processing liquid comes to flow in an active manner to the upstream side of the conveying direction of the support roll 1 of the photo-sensitive material. If the photo-sensitive material is processed under such condition, when the processed tip of the photo-sensitive material is brought into contact with the support roll 1 of the photo-sensitive material, more processing liquid can be supplied to the tip of the photo-sensitive material. Subsequently, when the tip of the photo-sensitive material reaches the tip of the slot die 2, continuous application of the processing liquid 7 is conducted. Further, before the photo-sensitive material reaches the tip of the slot die 2, the amount of the outflux of the processing liquid 7 flowed from the tip of the slot die 2 may be more than the amount of flux at the time when the processing liquid 7 is applied to the photo-sensitive material P.

The timing at which the processing liquid 7 starts outpouring from the tip of the slot die 2 and the timing at which the support roll 1 of the photo-sensitive material start driving are not necessarily the same. Further, while it is required that the support roll 1 of the photo-sensitive material should be rotated in the direction opposite to the conveying direction of the photo-sensitive material P at least until the photo-sensitive material reaches the position of the slot die 2, the support roll 1 of the photo-sensitive material may be stopped at the time when the photo-sensitive material P reaches the slot die 2. Taking into consideration the occurrence of flaws or the like on the back of the photo-sensitive material, the driving means is preferably controlled such that the support roll 1 of the photo-sensitive material is rotated in the same direction and at the same speed as the conveying direction and speed of the photo-sensitive material P at the time when the photo-sensitive material P reaches the slot die 2.

Since the peripheral speed at the time when the support roll 1 of the photo-sensitive material is rotated in the direction opposite to the conveying direction is largely associated with the formation of a liquid film (amount of the pooling of the processing liquid) between the tip of the slot die 2 and the support roll 1 of the photo-sensitive material, the driving means 18 is set so that the peripheral speed is slower than at least the conveying speed of the photo-sensitive material. Generally speaking, when the conveying speed of the photo-sensitive material P is set to 10 to 40 mm/second, the peripheral speed of the support roll 1 of the photo-sensitive material is set to 5 to 30 mm/second, preferably 5 to 20 mm/second.

Figure 2:
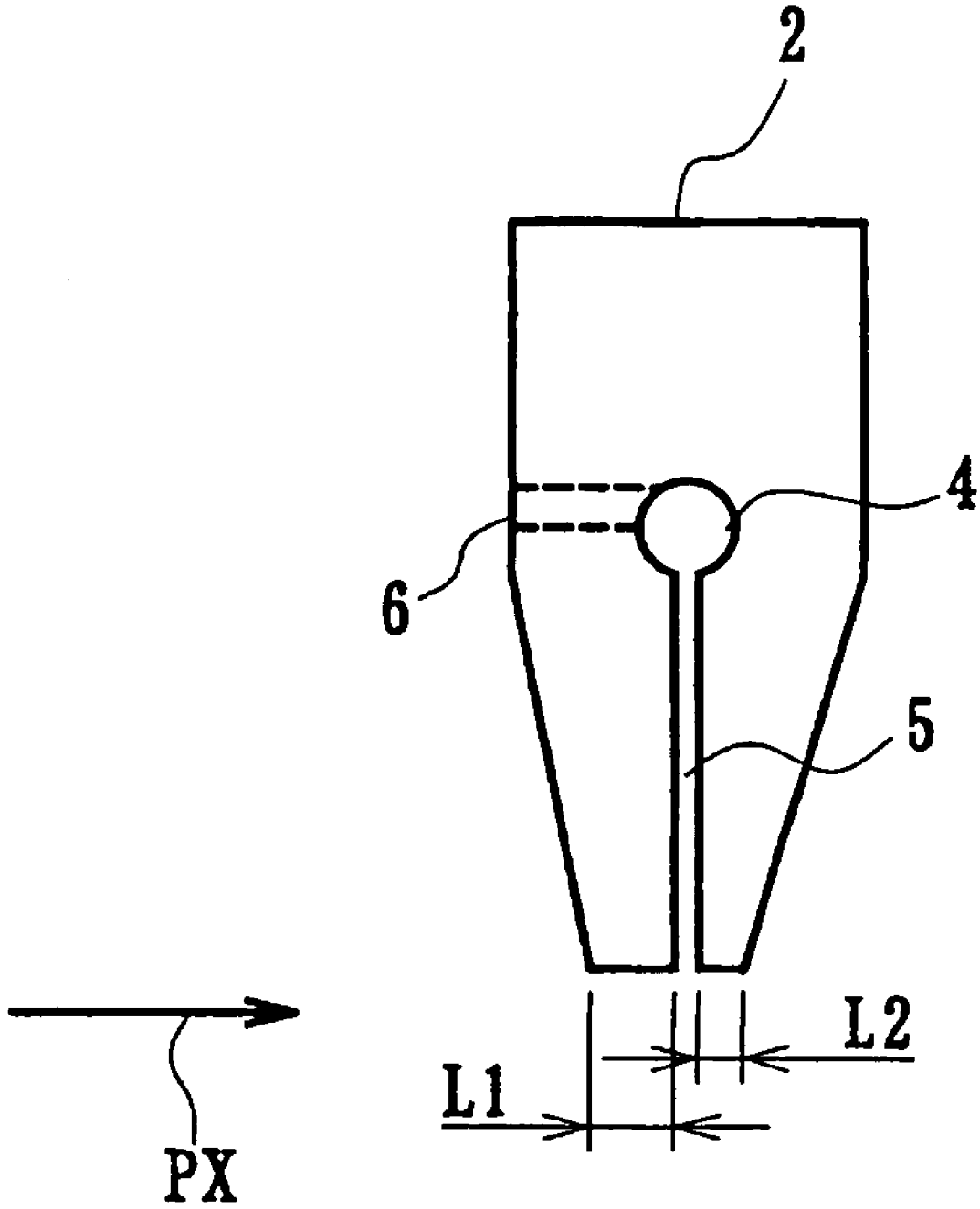
FIG. 2 is a cross section view of the slot die showing one embodiment of the present invention.

Further, as shown in FIG. 2, the length of the flat surface in the conveying direction of the tip of the slot die 2 should be divided into a flat surface at the downstream side of the conveying direction and a flat surface at the upstream side in the conveying direction with respect to the slit 5, and the length L1 of the flat surface at the upstream side should be longer than the length L2 of the flat surface at the downstream side, thereby achieving a further great effect in uniform application at the tip of the photo-sensitive material. By lengthening the length L1 of the flat surface at the upstream side more than the length L2 of the flat surface at the downstream side, the processing liquid outpouring from the tip of the slot die 2 spreads over a wider flat surface, resulting in the formation of a large liquid film (the processing liquid pooling in a large amount) at the upstream side of the slit 5. It is appropriate that the length L2 of the flat surface at the downstream side should be about 1 to 3 mm, and the length L1 of the flat surface at the upstream side should be about 3 to 8 mm.

As a method for lengthening the length L1 of the flat surface at the upstream side more than the length L2 of the flat surface at the downstream side in the conveying direction of the photo-sensitive material in the flat surface at both sides across the slit 5 of the tip of the slot die 2, each of the flat surfaces of the tip of the slot die 2 is preferably worked so as to have different lengths (thicknesses) as shown in FIG. 2.

Next, a description is given regarding a processing device of a photo-sensitive material comprising a supply means of a rinsing liquid for supplying a rinsing liquid to the support roll of the photo-sensitive material, and a diffusion means of a rinsing liquid for diffusing the rinsing liquid supplied to the support roll of the photo-sensitive material, the diffusion means being arranged in such a manner as to abut the support roll of the photo-sensitive material.

As shown in FIG. 1, there are provided with the support roll 1 of the photo-sensitive material, a reservoir tank 20 for pooling the rinsing liquid 12 for rinsing the tip of the slot die 2, and the rinsing liquid supply means comprising a pump 14 and a piping 15 for sending the rinsing liquid 12, and a rinsing liquid diffusion member 3 of the rinsing liquid diffusion means parallel to and having a length equivalent to the support roll 1 of the photo-sensitive material is arranged in such a manner as to abut the support roll 1 of the photo-sensitive material. For the rinsing liquid diffusion member 3 which constitutes a rinsing liquid diffusion means, a roll is preferable, and thus a roll is used in the present embodiment.

The rinsing liquid diffusion member 3 is arranged so as to be positioned at the same height or slightly upward with respect to the central axis in the horizontal direction of the support roll 1 of the photo-sensitive material, and may be provided at either the upstream side or the downstream side in the conveying direction of the support roll 1 of the photo-sensitive material. Further, the diameter of the rinsing liquid diffusion member 3 formed from a roll is set to the ratio of 0.2 to 0.8 with respect to the support roll 1 of the photo-sensitive material, i.e., about 5 to 30 mm. The surface material formed from a roll is not particularly limited if it has corrosion resistance against the processing liquid and high roundness, and for example stainless steel, plastics, fluorine resin or the like can be used. The rinsing liquid diffusion member 3 formed from a roll is preferably brought into contact with the support roll 1 of the photo-sensitive material all over in the application width direction, and may be either rotated or fixed.

Figure 3:
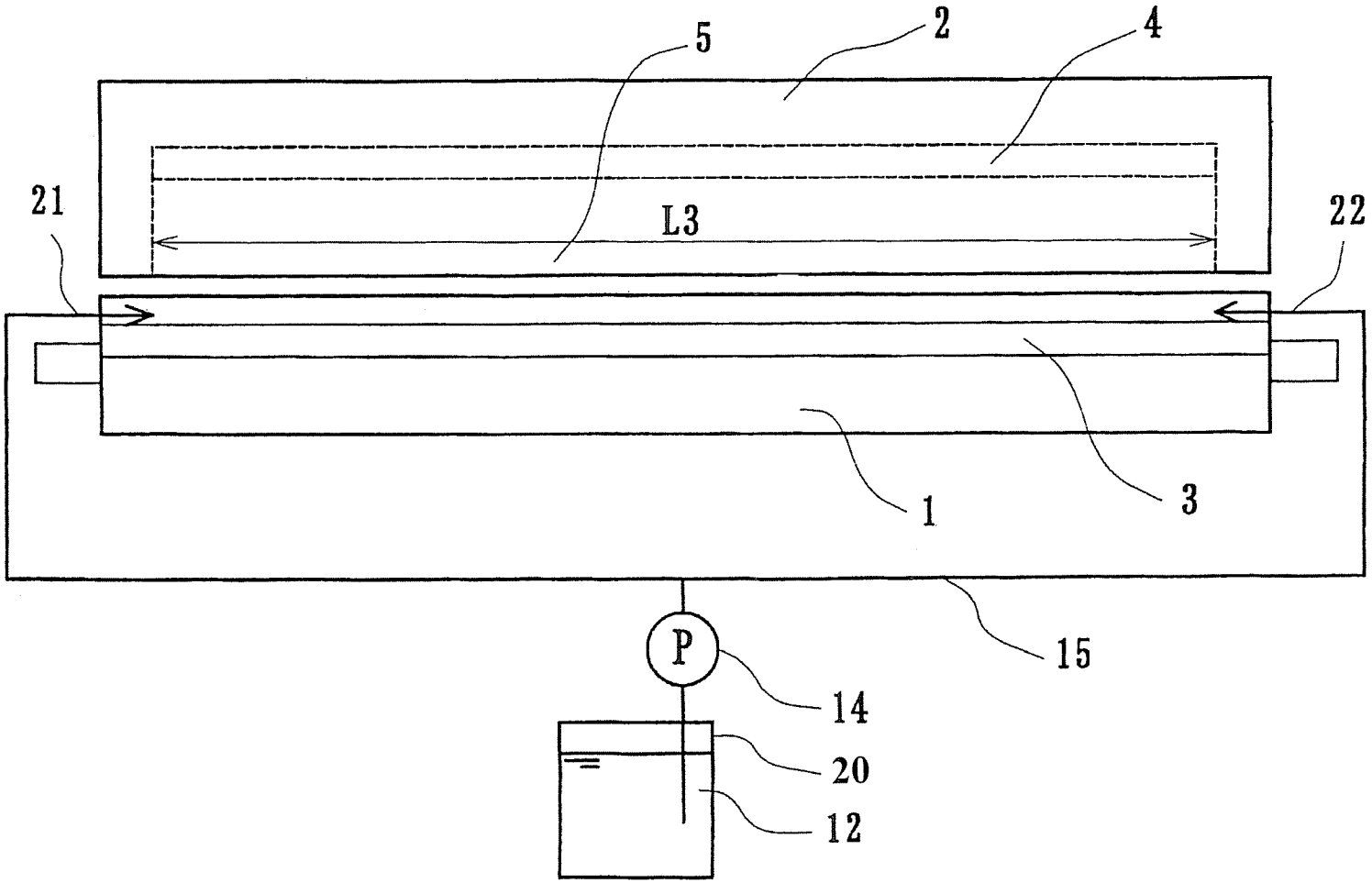
FIG. 3 is a front view of the support roll of the photo-sensitive material and the slot die showing one embodiment of the present invention.

The rinsing liquid 12 is preferably applied to the upper part of the section where the support roll 1 of the photo-sensitive material abuts the rinsing liquid diffusion member 3. For example, as shown in FIG. 3, the piping 15 should be branched into two portions through the pump 14 which serves to send the rinsing liquid from a rinsing liquid reservoir tank 20 in which the rinsing liquid 12 is filled. The branched piping 15 should be arranged on both sides of application width L3 of the slot die 2, and nozzles 21 and 22 should be provided at each rinsing liquid supply port. Thereby, less rinsing liquid 12 can be spread effectively all over the application width direction while forming a pool at the upper part of the abutment of the support roll 1 of the photo-sensitive material and the rinsing liquid diffusion member 3. The supply of the rinsing liquid 12 is not particularly limited if conducted in a method of supplying the liquid to the upper part of the section where the support roll 1 of the photo-sensitive material abuts the rinsing liquid diffusion member 3 as mentioned above, and a shower pipe or the like may be used which is worked so as to outpour the rinsing liquid uniformly in the application width direction.

In the embodiment of the present invention, the rinsing liquid diffusion member 3 formed from a roll was used as rinsing liquid diffusion means. However, the rinsing liquid diffusion member 3 is not limited to a roll if it constitutes means for spreading the rinsing liquid all over in the application width direction as mentioned above. For example, a plate-like material having a length equivalent to the support roll 1 of the photo-sensitive material may be abutted to the support roll 1 of the photo-sensitive material all over in the application width direction.

It is preferable that the rinsing of the processing liquid applied section (the support roll 1 of the photo-sensitive material and the tip of the slot die 2) should be conducted when no normal processing is conducted or during the stoppage of the device. When no processing is conducted or during the stoppage of the device, the rinsing liquid remains at the applied section of the support roll 1 of the photo-sensitive material opposed to the tip of the slot die 2, arid is prone to be crystallized by being subjected to the air. Depending on the degree of the development of the crystal, it becomes difficult to rinse by the rinsing liquid alone supplied from the tip of the lot die 2. Thus, in the present invention, the rinsing liquid 12 is supplied periodically from the nozzles 21 and 22 using the pump 14 and the piping 15 which constitute the rinsing liquid supply means when no processing is conducted or during the stoppage of the device. Further, the support roll 1 of the photo-sensitive material is preferably rotated at the same timing as the supply of the rinsing liquid 12, and as a result the rinsing liquid 12 can be supplied to the tip of the slot die 2 and the overall surroundings of the support roll 1 of the photo-sensitive material, leading to a great effect in preventing the crystallization of the processing liquid.

The above-mentioned wording "when no processing is conducted or during the stoppage of the device" means a standby period from the last processing of the photo-sensitive material to the next processing of the photo-sensitive material. While the timing of outpouring the rinsing liquid 12 from the nozzles 21 and 22 is not particularly limited, the rinsing liquid 12 is preferably outpoured at the rate of once per 30 minutes to 3 hours in the period from the last processing of the photo-sensitive material to the next processing. For example, by letting memorize the time when the photo-sensitive material is processed last based on the signals from the detection means for detecting the photo-sensitive material, a period of time until the supply of the rinsing liquid 12 can be measured. Further, the amount of the outflux in one time is preferably 3 to 60 ml, and can be appropriately determined in accordance with the environmental condition and the application width.

The timing at which the support roll 1 of the photo-sensitive material is driven during rinsing is preferably simultaneous with the start of the supply of the rinsing liquid 12, and the peripheral speed of the support roll 1 of the photo-sensitive material during rinsing is set to about 10 to 40 mm/second. Further, the driving time from the start to the stop of the driving of the support roll 1 of the photo-sensitive material is set to about 30 seconds to 3 minutes.

While the rinsing liquid 12 for use in the present invention is not particularly limited, tap water with a small amount of surface active agent or organic solvent added, or a neutralizing liquid or a washing water which are used after a developer can be used. Further, the temperature of the rinsing liquid 12 may be controlled, in order to obtain a greater rinsing effect.

Figure 4:
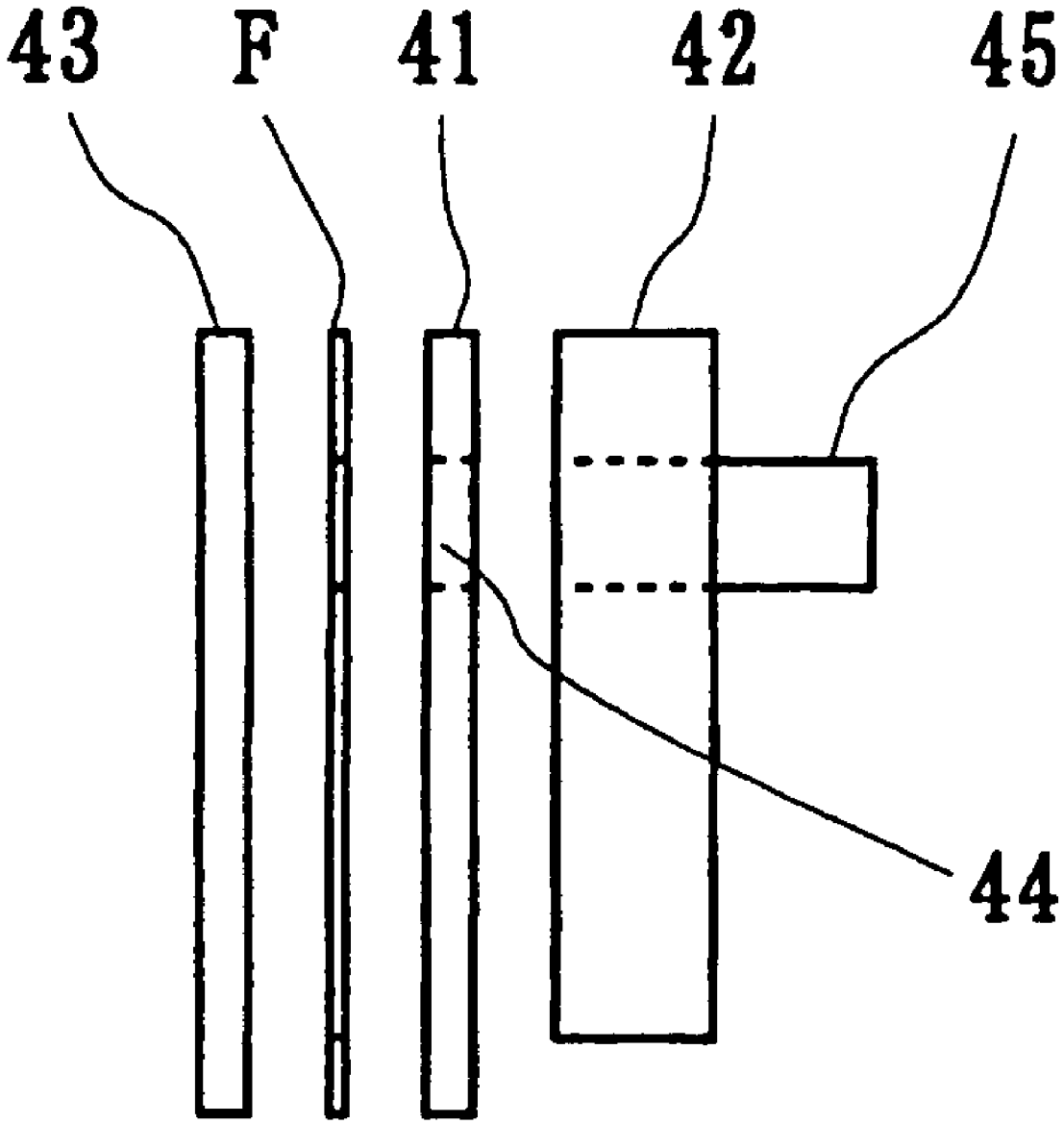
FIG. 4 is an exploded side view of the slot die showing one embodiment of the present invention.

In the processing device of the present invention, it is preferable to use as the slot die 2 a slot die which is produced easily at low cost. Hereinafter, a description is given regarding the easily produced slot die. FIG. 4 is a side view in which the slot die is broken down into the following respective component members. The slot die 2 has a flat plate 41 of which a groove 44 for forming a manifold is cut out, and flat plates 42 and 43 which fix the flat plate 41 by sandwiching it from both sides. A film F for forming a slit is interposed between the flat plate 41 and either the flat plate 42 or 43 (in the figure, between the flat plates 41 and 43). While a liquid supply port 45 may be provided either at the flat plate 42 or 43, it is preferable to provide at a plate at which the slit is not formed. The supply port 45 supplies the processing liquid to the groove 44. Two or more supply ports 45 may be provided.

As shown in FIG. 4, the lengths of the lower ends of the flat plates 41 and 43 which form a slit should be identical, and the length of the other plate 42 is preferably shorter than those of them. Also the length of the lower end of the film F is preferably identical to those of the flat plates 41 and 43, but the length may be slightly longer or slightly shorter.

Figure 5A:
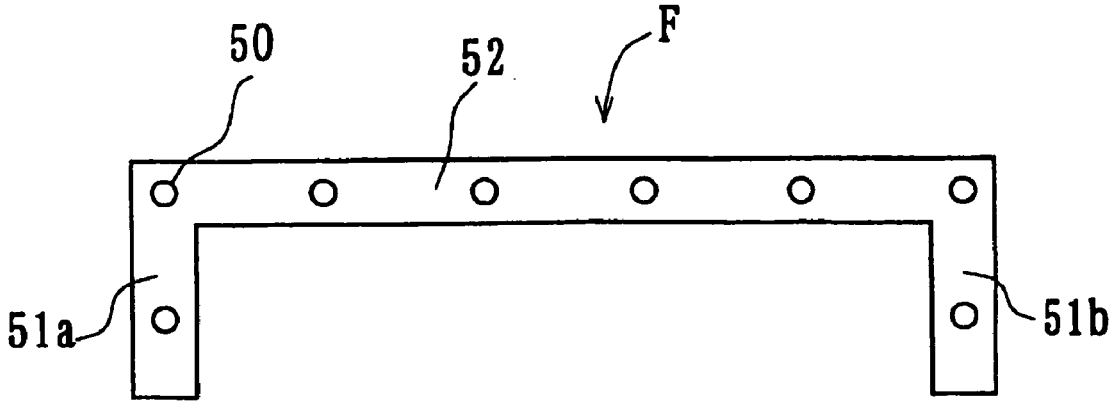
FIG. 5(*a*) is a plan view of the film F and FIG. 5(*b*) is a plan view of the preferred embodiment of the film F.
Figure 5B:
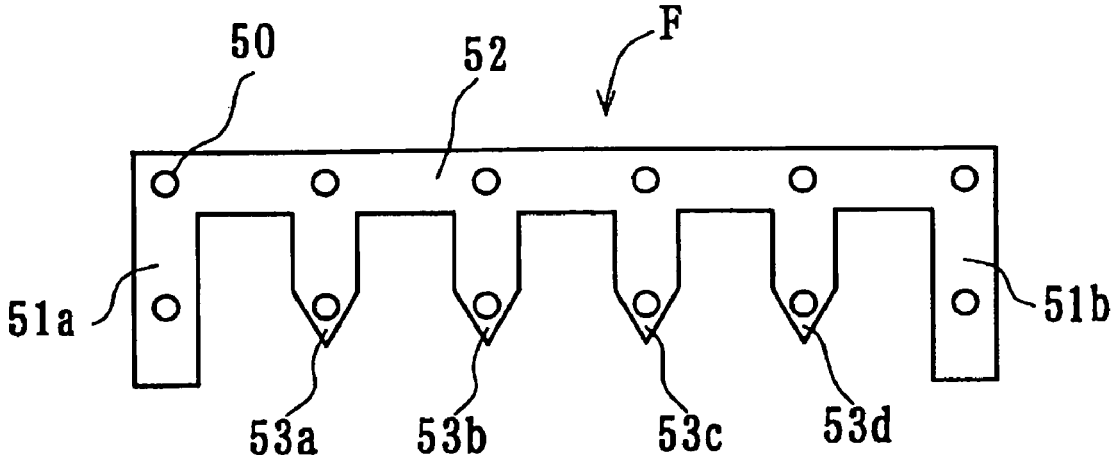

The film F to be inserted between the flat plates 41 and 43 serves to form between the flat plates 41 and 43 a slit which is continuous to the manifold, and a film having a thickness identical to the thickness of the predesigned slit is used therefor. For the material of a film, a plastic film such as polyethylene terephthalate or polyvinyl chloride is preferable, and the thickness thereof is generally about 50 to 300 μm The film F is not particularly limited if shaped in such a manner as to form a slit in the lower part of the slot die. For example, as shown in FIG. 5(*a*), a film F shaped in such a maimer as to open only in the lower end and seal both side ends 51*a* and 51*b* and an upper end 52 can be used, but the shape shown in FIG. 5(*b*) is preferable. While a film F in FIG. 5(*b*), in the same manner as in FIG. 5(*a*), opens only in the lower end and seals both the side ends 51*a* and 51*b* and the upper end 52, it further has a plurality of flaps 53*a* to 53*d* which are integrated with the upper end 52. Each flap has such a length as to be interposed (positioned) inside the slit.

Figure 6:
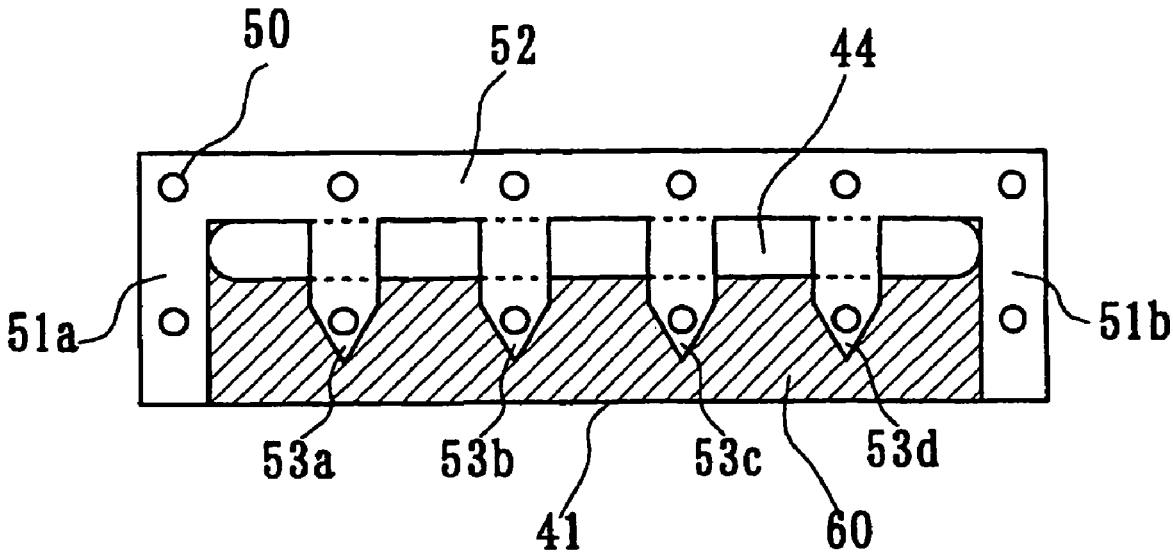
FIG. 6 is a plan view of the flat plate 41 with the film F superimposed thereon.

Shown in FIG. 6 is a plan view at the time when the film F shown in FIG. 5(*b*) is superimposed on the flat plate 41. A groove 44 for forming a manifold is cut out of the plate 41, and both the side ends 51*a* and 51*b* and the upper end 52 of the film F are superimposed so as not to cover the groove 44 (while, in the present invention, it is acceptable that they may cover a part of the groove 44 in such a degree as not to inhibit the function of the manifold). While not shown diagrammatically, by further superimposing the flat plate 43 thereon, a slit 60 indicated by slanted lines are formed. The slit 60 is connected to the manifold (groove 44), and the liquid supplied to the manifold and distributed in the width direction thereof passes through the slit 60, thereby forming a further uniform amount of flux in the width direction so as to be applied to a photo-sensitive material or the like. What is important in this respect is to keep the thickness of the slit 60 uniform in the width direction, and what serves for this purpose is the flaps 53*a* to 53*d* of the film F. That is, by inserting this flap into the slit 60 and fixing the flat plates 41 and 43 with bolts, screws, or the like, a slit having a uniform thickness in the width direction can be easily formed. Indicated by reference numerical 50 in FIGS. 5 and 6 is a hole for the fixation using a bolt or a screw.

The simplified slot die for use in the present invention can be formed by a quite simple combination of interposing the film F between the flat plates 41 and 43. However, as the application width (the length of the width direction of the slot die) becomes longer, deflection in the thickness of the slit may occur in the application width direction. This deflection can be overcome by simple means of interposing (positioning) the flaps which is integrally provided with the film F in the slit with appropriate spaces. The shapes or the like of the flap for securing uniform flow within the slit are described below.

While the number of the above-mentioned flaps can be appropriately selected depending on the application width, even one flap can achieve the effect sufficiently. Preferably, the flaps should be spaced 3 to 20 cm apart. More preferably, the flaps should be spaced 3 to 10 cm apart. The width of a flap is preferably set to about 5 to 20 mm, the size by which a bolt or a screw for the fixation can be inserted, and should not be unnecessarily wider. The flap is preferably shaped such that the tip should be thinner. For example, a triangle shape, an angle shape, a semicircle shape, or the like is preferable. This flap once interrupts the flow of the liquid from the manifold to the slit partially, while at the tip of the slit (the section through which the liquid pours outside) it is required to produce a uniform flow in the width direction, and in this sense the shape and the number of the flap and the position of the tip should be selected. Above all, the shape of the flap and the position of the tip are important. The shape preferably tapers as mentioned above, and it is required that the position of the tip of the flap should be inner (upper) than the tip of the slit. While the distance between the tip of the flap and the tip of the slit varies depending on the shape of the tip of the flap, the distance is preferably 1 mm or more, and more preferably 2 mm or more.

As shown in FIG. 5(*b*), it is preferable that the flap 53 be provided integrally with the film F in assembling a slot die. However, the film F and the flap 53 may be provided separately, and the flap 53 may be independently interposed inside the slit. In this case, the shape and the position of the tip of the flap 53 follow the above description. In any case, the film F and the flap 53 may have identical thickness.

For the material of the flat plates 41, 42 and 43, a plastic resin such as acryl, polycarbonate or vinyl chloride, or stainless steel can be used, but stainless steel is preferably used. The thickness of the flat plate 41 affects the size of a manifold 44 depending on a groove which is cut out. In the present invention, the sectional area (cross section orthogonal to the width direction) of the manifold 44 is preferably within the range of 10 to 100 square millimeters, particularly preferably within the range of 10 to 80 square millimeters, and further preferably within the range of 10 to 50 square millimeters. Accordingly, it is appropriate that the thickness of the flat plate 41 is preferably about 1 to 8 mm. Further, while the flat plates 41 and 43 form a slit, it is required that a surface which forms a slit should be smoothly polished. For the flat plates 41 and 43, a cold-rolled stainless (2B) also in No. 4, the classification meaning going through mechanical polishing is preferably used. The thickness of the flat plate 43 is 1 to 8 mm. For the flat plate 42, relatively thick stainless is used in order to control flexure or the like which occurs when thinner stainless is used for the flat plates 41 and 43. It is appropriate that the thickness of the flat plate 42 should be about 5 to 15 mm.

The size of the groove 44 which is cut out of the flat plate 41 for forming a manifold is as mentioned above regarding the sectional area. Depending on the thickness of the flat plate 41, the length in the vertical direction (a direction in which the liquid falls) varies, but it is appropriate that the length in the vertical direction of the grove 44 should be about 5 to 20 mm. Further, the length in the width direction of the groove 44 can be appropriately set depending on the application width, but is preferably equivalent to or slightly longer than the application width. Usually, the application width and the length in the width direction of the slit 60 are designed to be equivalent, while the length in the width direction of the above-mentioned groove 44 may be shorter than the application width if it is a sufficient length for spreading the liquid which falls through the slit 60 uniformly in the width direction.

The sectional area of the manifold (groove 44) is not necessarily constant throughout the width direction of the slot die, and for example the sectional area may be tapered as reaching the end in order to further improve the uniformity of the flux of the outpouring processing liquid in the width direction.

Figure 7B:
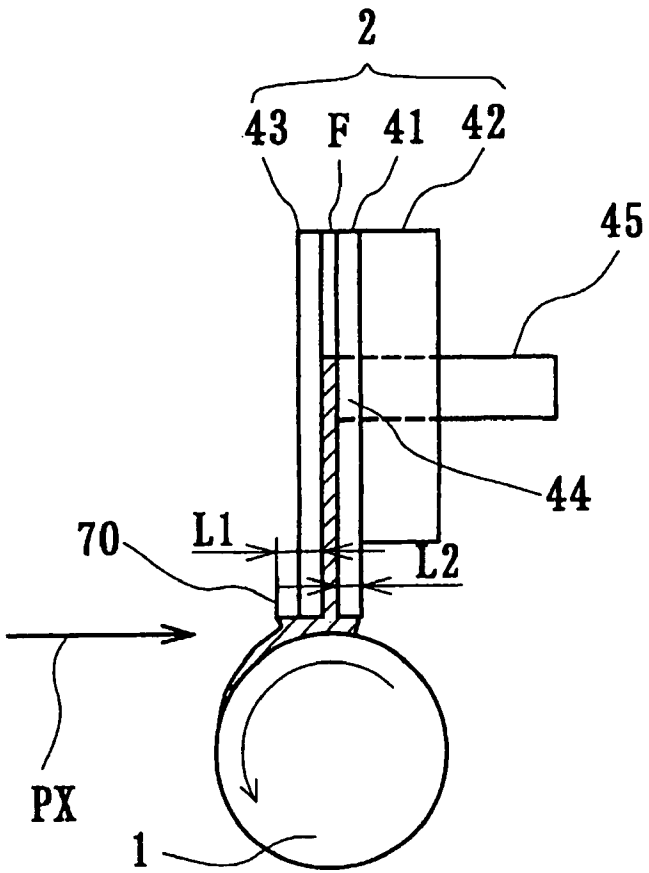
FIG. 7(*a*) is a side view of the slot die showing one embodiment of the present invention and FIG. 7(*b*) is a side view of the slot die showing another embodiment of the present invention.
Figure 7A:
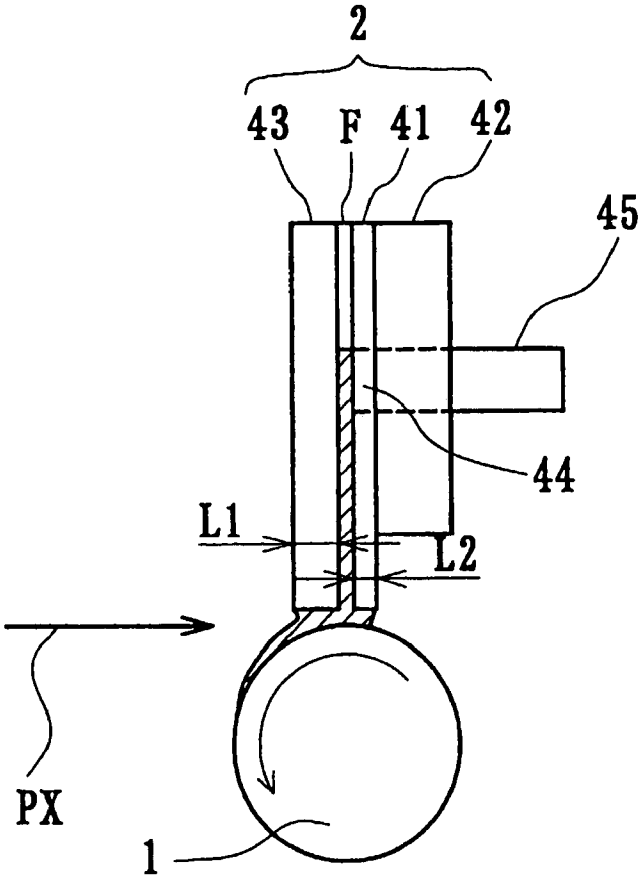

When using the above-mentioned slot die 2 produced in a simplified manner in the processing device of the present invention, as a method for lengthening the length L1 of the flat surface at the upstream side more than the length L2 of the flat surface at the downstream side in the conveying direction of the photo-sensitive material in the flat surface at both sides across the slit film F of the tip of the slot die 2, for example as shown in FIG. 7 (a) the slit film F may be sandwiched by the flat plates 41 and 43 which have different thicknesses from each other. Further, as shown in FIG. 7(*b*), an upstream side flat surface extension member 70 such as a film or a resin may be attached to the tip of the flat plate 43 at the upstream side of the slot die 2 all over the application width direction, such that the length of the flat surface at the upstream side of the tip of the slot die 2 should be longer.

The present inventors have found that the conventional problems of nonuniformity of the application at the very tip of a photo-sensitive material and at both ends in the application width direction causing the unevenness in the process to be prone to occur can be overcome using a processing device of a photo-sensitive material comprising conveying means for conveying a photo-sensitive material, a slot die for applying a processing liquid to the photo-sensitive material conveyed by the conveying means, a reservoir tank of the processing liquid, processing liquid supply means for supplying a processing liquid in the reservoir tank of the processing liquid to the slot die, a support roll of the photo-sensitive material arranged at a position facing to and spaced from the tip of the slot die, means for detecting a photo-sensitive material, and driving means for rotating the support roll of the photo-sensitive material at least in the direction reverse to the conveying direction of the photo-sensitive material. Further, the present inventors have found that the conventional problems of a large amount of the remainder of the processing liquid on the support roll of the photo-sensitive material and at the tip of the slot die causing fixation and crystallization to be prone to occur can be overcome using a photo-sensitive material processing device, wherein rinsing liquid supply means for supplying rinsing liquid to the support roll of the photo-sensitive material and rinsing liquid diffusion means for diffusing a rinsing liquid to the support roll of the photo-sensitive material are arranged in such a manner as to abut to the support roll of the photo-sensitive material.

The invention claimed is:

1. A processing device of a photo-sensitive material, comprising:

conveying means for conveying a photo-sensitive material;

a slot die for applying a processing liquid to the photo-sensitive material conveyed by the conveying means;

a reservoir tank of the processing liquid;

supply means of the processing liquid for supplying a processing liquid in the reservoir tank of the processing liquid to the slot die;

a support roll of the photo-sensitive material arranged at a position opposite to and spaced from a tip of the slot die;

detection means for detecting a position of the photo-sensitive material;

driving means for rotating the support roll of the photo-sensitive material which can rotate the support roll at least in the direction reverse to a conveying direction of the photo-sensitive material; and supply control means of the processing liquid for controlling the supply and stop of the processing liquid from the supply means of the processing liquid, the supply control means of the processing liquid being controlled so as to start supplying the processing liquid to the slot die before the photo-sensitive material is conveyed to the position of the slot die by receiving signals from the detection means of the photo-sensitive material.

2. The processing device of a photo-sensitive material according to claim 1, further comprising:

rotation control means for controlling the rotation of the support roll of the photo-sensitive material, wherein, the support roll of the photo-sensitive material is controlled so as to be rotated in the direction reverse to the conveying direction of the photo-sensitive material before the photo-sensitive material is conveyed to the position of the slot die by receiving signals from the detection means of the photo-sensitive material, and at the point in time when the photosensitive material reaches the position of the slot die, the support roll of the photo-sensitive material is controlled so as to be stopped rotating or rotated in the same direction as the conveying direction of the photo-sensitive material.

3. processing device of a photo-sensitive material according to claim 1, wherein a peripheral speed of the support roll of the photo-sensitive material is made slower than a conveying speed of the photo-sensitive material.

4. The processing device of a photo-sensitive material according to claim 1, further comprising:

supply means of a rinsing liquid for supplying the rinsing liquid to the support roll of the photo-sensitive material.

5. The processing device of a photo-sensitive material according to claim 4, further comprising:

diffusion means of a rinsing liquid for diffusing the rinsing liquid supplied to the support roll of the photo-sensitive material arranged in such a manner as to in contact with the support roll of the photo-sensitive material.

6. The processing device of a photo-sensitive material according to claim 1, wherein the slot die has at least a manifold and a slit, and wherein the relationship between the lengths in the conveying direction of the photo-sensitive material of the flat surface of the tip at both ends across the slit at the tip of the slot die satisfies the following condition: (condition) Length of the flat surface of the tip at the upstream side (L1)>Length of the flat surface of the tip at the downstream side (L2).

7. The processing device of a photo-sensitive material according to claim 1, wherein the support roll of the photo-sensitive material includes a metal roll and a tubular fluorine resin wound around a surface of the metal roll.

8. A processing device of a photo-sensitive material, comprising:

conveying means for conveying a photo-sensitive material;

a slot die for applying a processing liquid to the photo-sensitive material conveyed by the conveying means;

a reservoir tank of the processing liquid;

supply means of the processing liquid for supplying a processing liquid in the reservoir tank of the processing liquid to the slot die;

a support roll of the photo-sensitive material arranged at a position opposite to and spaced from a tip of the slot die;

detection means for detecting a position of the photo-sensitive material;

driving means for rotating the support roll of the photo-sensitive material which can rotate the support roll at least in the direction reverse to a conveying direction of the photo-sensitive material, wherein the slot die has at least a manifold and a slit, wherein the relationship between the lengths in the conveying direction of the material of the flat surface of the tip at both ends across the slit at the tip of the slot die satisfies the following condition: (condition) Length of the flat surface of the tip at the upstream side (L1) >Length of the flat surface of the tip at the downstream side (L2).

* * * * *